United States Patent [19]

Miller

[11] Patent Number: 4,927,104

[45] Date of Patent: May 22, 1990

[54] COLLAPSIBLE BAG-SUPPORTING FRAME

[76] Inventor: Robert W. Miller, 11731 26th NE., Seattle, Wash. 98125

[21] Appl. No.: 355,599

[22] Filed: May 22, 1989

[51] Int. Cl.[5] ..... A63B 55/04

[52] U.S. Cl. ..... 248/97; 248/150

[58] Field of Search ..... 248/97, 99, 101, 165, 248/166, 150; 211/189; 232/43.1, 43.2; 141/316, 390; 220/404

[56] References Cited

U.S. PATENT DOCUMENTS

| | | | |
|---|---|---|---|
| 434,514 | 8/1890 | Lamb | 248/97 |
| 666,045 | 1/1901 | Beeson | 248/97 |
| 957,260 | 5/1910 | Sackett | 248/97 |
| 999,406 | 8/1911 | Skelton | 248/97 |
| 1,414,575 | 5/1922 | McCart | 248/165 X |
| 2,100,235 | 11/1937 | Brown | 248/97 |
| 2,442,377 | 6/1948 | Regele | 248/101 |
| 3,261,545 | 7/1966 | Frazier | 248/101 X |
| 3,638,888 | 2/1972 | Ross | 248/153 X |
| 4,473,176 | 9/1984 | Harper | 248/552 X |
| 4,488,697 | 12/1984 | Garvey | 248/101 X |

*Primary Examiner*—J. Franklin Foss

*Attorney, Agent, or Firm*—Ward Brown; Robert W. Beach

[57] ABSTRACT

A normally horizontal base section supports the side section of a frame in upright position. A top section of the frame is normally positioned horizontally and has an open interior through which the lip of a bag can be inserted. The bag lip is wrapped downward over the outer periphery of the top section whereupon a rigid clamping ring is inserted over the top section to hold the bag lip in position. After filling of the bag, the clamping ring is removed, thereby releasing the lip of the bag for removal and, if desired, insertion of a new bag. When not in use, the base and top sections of the frame can be swung relative to the side section so as to extend parallel thereto for compact storage.

9 Claims, 3 Drawing Sheets

Fig. 1
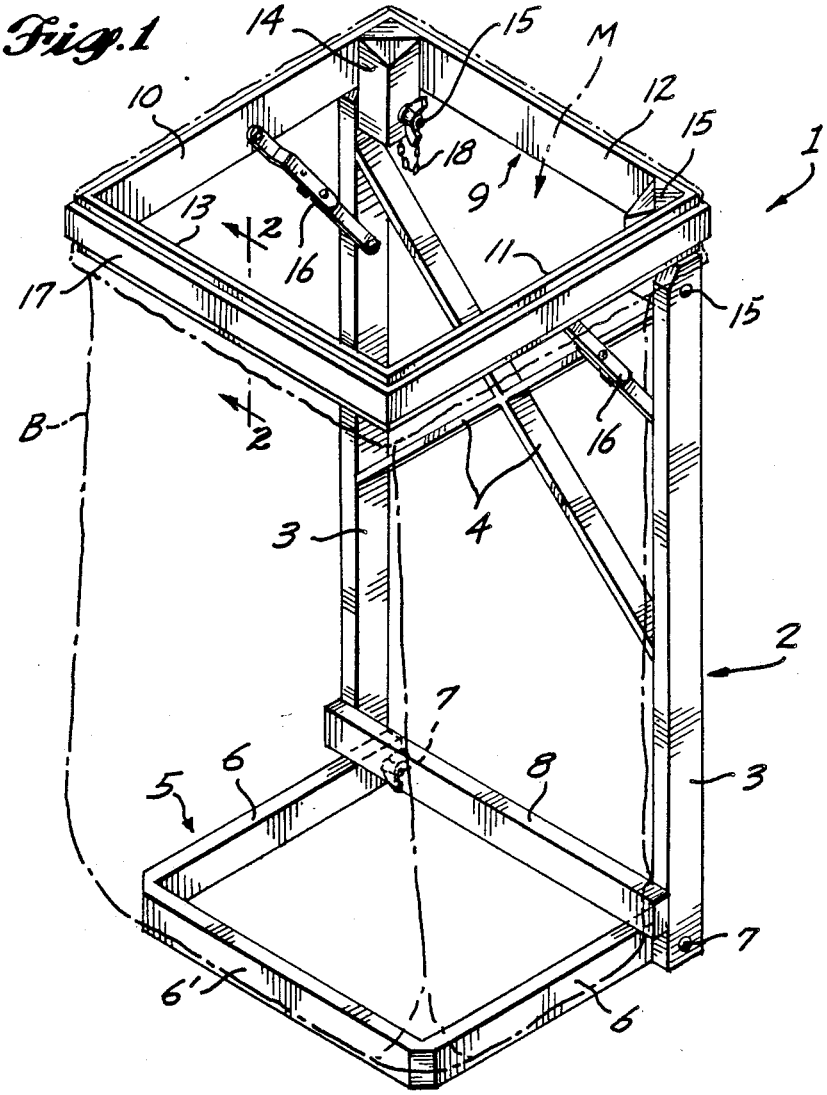
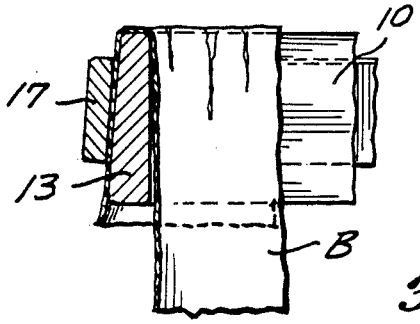
Fig. 2.

COLLAPSIBLE BAG-SUPPORTING FRAME

BACKGROUND OF THE INVENTION

1. Field of the Invention

The present invention relates to waste receptacles. More specifically, the present invention relates to portable mechanism for holding a bag upright with its mouth open for convenient introduction of the articles to be deposited in the bag.

2. Prior Art

There is a known wheeled hand truck convertible to a dolly with a tall vertical handle. Interfitting slots and pins are provided for connecting a ring to the upper portion of the vertical handle such that the ring extends more or less perpendicularly outward from the handle. The intention is to insert a trash bag downward through the ring and wrap the lip of the bag over part of the top of the ring. A broad loose elastic band is provided to encircle the ring and retain the bag in position. It can be difficult to connect the ring to the handle. The ring is loosely held and sometimes may become inadvertently disconnected. The handle can interfere with wrapping the entire circumference of the lip of the bag over the ring. It can be difficult and time-consuming to secure the elastic band around the ring. Even when care is taken in the assembly and bag-connecting procedure, the elastic band may slip off or the bag lip may slide out from between the ring and the band. Consequently, it has been found to be as convenient to utilize the conventional method, namely, a solid nonconvertible trash container with or without a bag liner.

SUMMARY OF THE INVENTION

The principal object of the present invention is to provide an improved bag support which can be converted quickly and easily from a compact condition in which it may be stowed to a sturdy reliable support for a trash bag holding the mouth of the bag open even while trash, clippings or other articles are deposited into the bag, but which allows the bag to be separated from the support quickly without dumping any of the contents so that another bag can be quickly positioned for reception of additional trash, clippings or other articles.

In the preferred embodiment of the present invention the foregoing object is accomplished by providing a collapsible bag-supporting frame having a side section, a base section swingable from a position nested inside the side section to a position projecting horizontally outward at the bottom to support the side section upright and a top section swingable from a collapsed position extending close alongside the side section to an upper horizontal position forming an open ring for reception of the lip portion of a large trash bag. The lip portion of the bag can be folded over the top section and a separate clamping ring can be inserted downward over the top section to clamp the bag lip in position. Manually releasable locking braces normally maintain the top section in horizontal position extending over the base section, and the base section is normally held in horizontal position by a stop. The top section is designed such that there are no obstructions to interfere with folding the entire circumference of the bag lip over the top section and so that the possibility of puncturing the bag during insertion is minimized. At the end of the process of depositing trash or other articles in the bag, the clamping ring can be removed manually for easy separation of the bag from the frame. The composite frame can be quickly folded back to its collapsed, essentially flat condition for compact storage.

BRIEF DESCRIPTION OF THE DRAWINGS

FIG. 1 is a somewhat diagrammatic top perspective of a collapsible bag-supporting frame in accordance with the present invention with a bag shown in broken lines.

FIG. 2 is an enlarged fragmentary section along line 2—2 of FIG. 1, but with the bag shown in solid lines and parts broken away.

DETAILED DESCRIPTION

Figure 3:
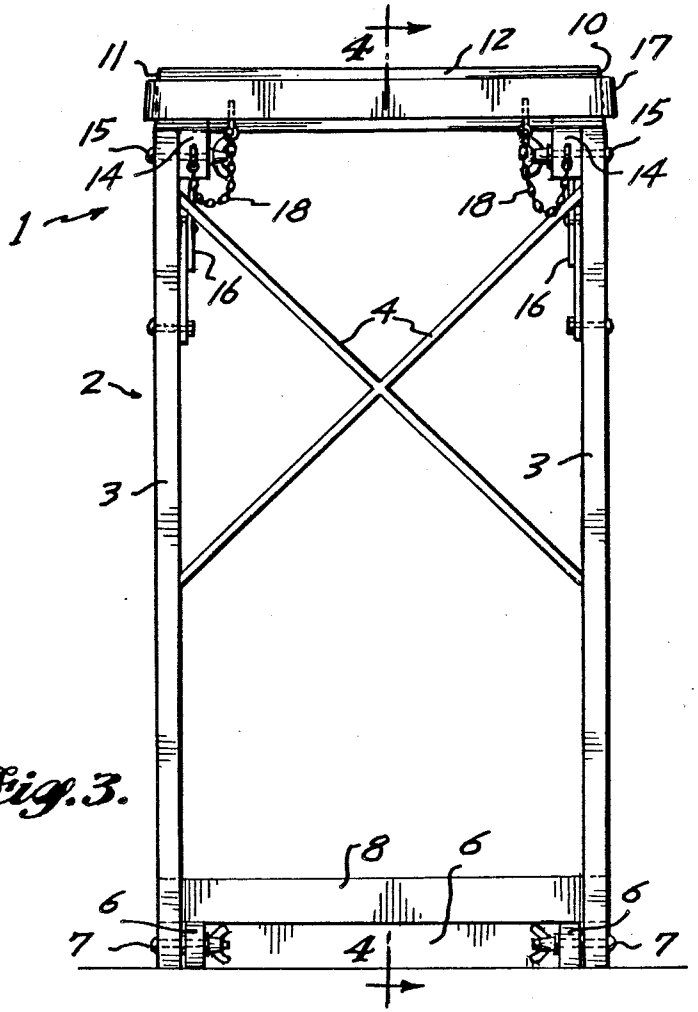
FIG. 3 is a rear elevation of the collapsible bag-supporting frame of FIG. 1.

With reference to FIG. 1, the collapsible bag-supporting frame 1 in accordance with the present invention is intended to hold a bag B in upright condition with the mouth M of the bag open for convenient introduction of trash or other articles into the bag. In the preferred embodiment, the frame 1 includes a side section 2 having upright, transversely spaced corner posts 3 rigidly connected together by cross braces 4. The cross braces are positioned toward the upper end portion of the side section 2 leaving an open unobstructed portion at the bottom between the posts.

A bottom section 5 of the frame 1 is formed by a pair of parallel legs 6 having corresponding ends pivotally connected to the bottom end portions of the corner posts 3 by appropriate pins 7 and connectors, such as the bolts and wing nuts shown. Preferably, the free or swinging ends of the legs 6 are connected together by a crosspiece 6'. The degree of swinging of the base section 5 relative to the side section 2 is limited by stops such as the spreader bar 8 extending horizontally between the lower end portions of the corner posts 3 directly above the legs 6 of the base section 5.

Figure 4:
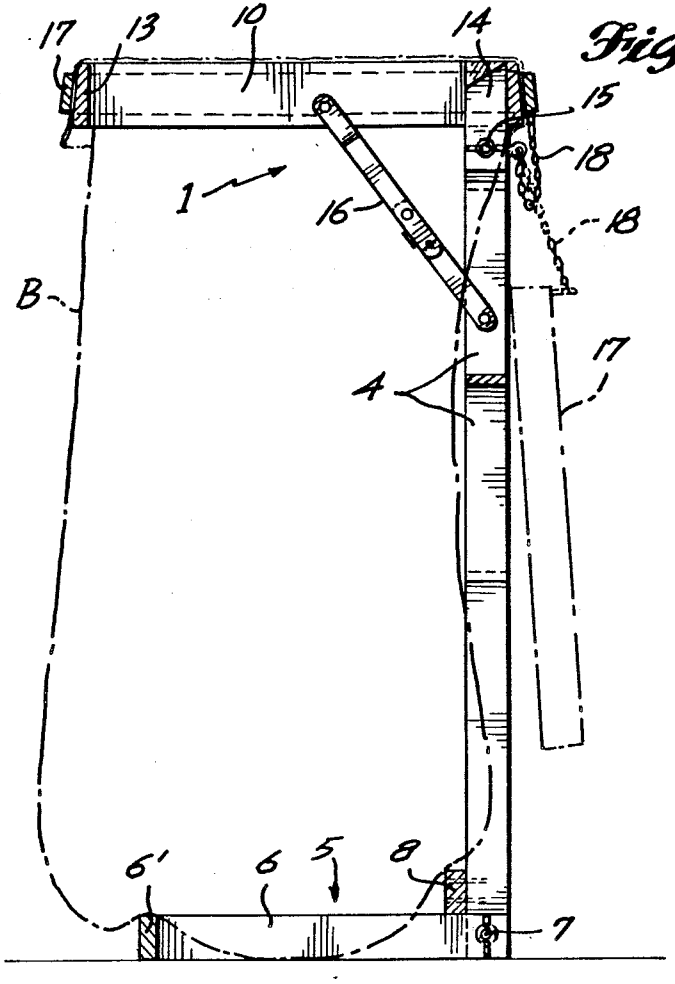
FIG. 4 is a somewhat diagrammatic section along line 4—4 of FIG. 3.
Figure 5:
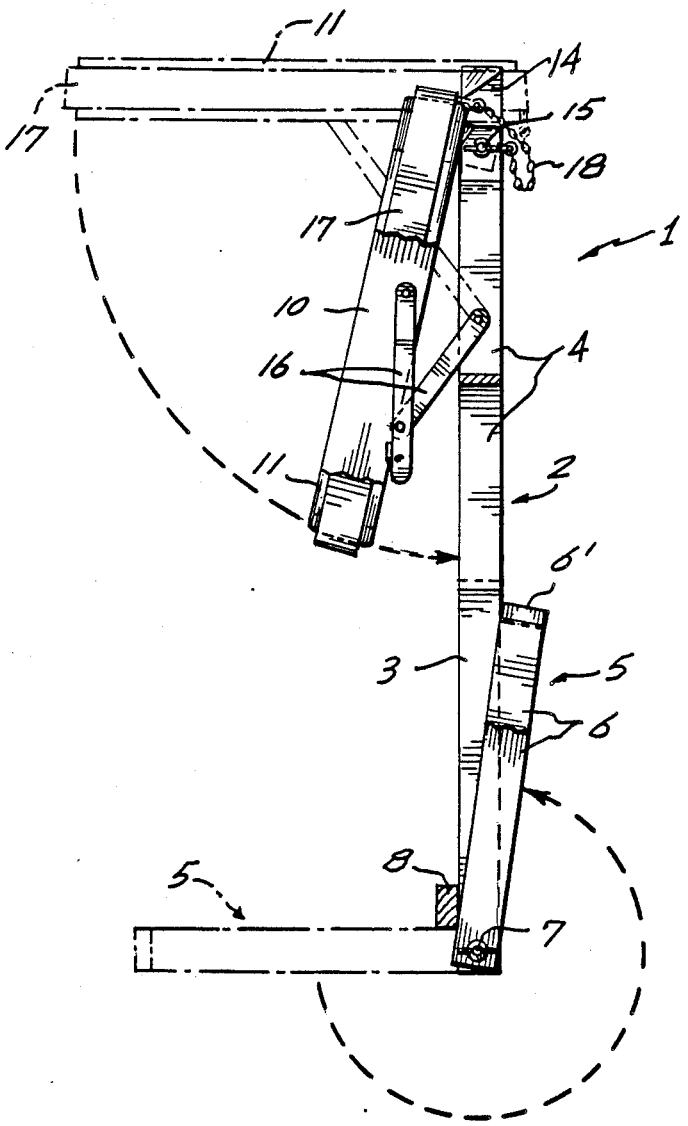
FIG. 5 is a diagrammatic end elevation of the collapsible bag-supporting frame of FIG. 1, illustrating collapsing of the frame from its bag-holding condition to its compact storage condition.

In the condition shown in FIGS. 1 and 4, the legs 6 extend horizontally outward substantially perpendicular to the side section 2 and upward swinging of the legs is limited by engagement against the spreader bar 8. Nevertheless, as illustrated in FIG. 5, the entire base section 5 can be rotated 270 degrees counterclockwise from the broken line position of FIG. 5 (the solid line position of FIG. 1) to a position in which the base section is nested inside the side section between the corner posts 3 below the cross braces 4. From the nested position, additional counterclockwise swinging of the base section forward and outward from the side section is prevented by the spreader bar 8.

Returning to FIG. 1, the frame 1 also includes a top section or bag ring 9 preferably of substantially square shape having elongated sidepieces 10 and 11 connected by elongated end pieces 12 and 13. Each side piece and end piece is substantially longer than it is wide (high) and substantially wider than it is thick. In order to pivotally connect the top section or bag ring 9 to the upper portion of the frame side section 2, two small filler blocks or stubs 14 are fitted and rigidly secured in the adjacent corners between the opposite ends of end piece 12 and the adjacent end portions of the sidepieces 10 and 11. The stubs have downward-projecting portions extending below the plane of the bottom edges of the end pieces and sidepieces. Such projecting portions extend close alongside and are pivotally connected to the upper end portions of the corner posts 3 by appropriate pins 15 and connectors which preferably are bolts having threaded inner end portions extending through the projecting portions of the stubs 14 for receiving wing nuts to adjust the tightness of the hinged connection.

In the position shown in FIGS. 1 and 4, the frame top section 9 is maintained in its substantially horizontal position extending inward over the base section 5 by over center support hinges or braces 16. Each such support hinge or brace has one end connected to a corner post 3 and its other end connected to a sidepiece 10 or 11 of the frame top section 9.

The final component of the collapsible bag-supporting frame in accordance with the present invention is a rigid clamping ring 17 normally closely encircling the end pieces and sidepieces of the upper frame section 9, as shown in FIG. 1, for example. Ring 17 is formed such that its inner periphery is of substantially the same size and shape as the outer periphery of the top section 9, i.e., frame 17 has end pieces and sidepieces corresponding to the end pieces and sidepieces of the top section and is open in the middle such that it may be fitted over the frame top section so as to engage the outer periphery of the top section substantially contiguously. Although normally fitted over the top section, the clamping ring 17 can be removed manually, but preferably still is attached to the remainder of the frame by short flexible connectors, such as the chains 18 best seen in FIGS. 3 and 4. When separated from the top section 9, the ring 17 can hang alongside the side section 2 as indicated in broken lines in FIG. 4, such that it will not be misplaced and is readily accessible.

In use, with the clamping ring 17 detached from the frame top section 9, a trash bag can be inserted through the open center of the top section and have the lip portion folded outward and downward along the outer sides of the end pieces and top pieces 10, 11, 12 and 13. There are no obstructions interfering with folding of the entire circumference of the bag lip over the side pieces. Preferably, the top inner end portions of the filler blocks 14 are rounded or beveled downward and inward and, as best seen in FIG. 2, the top edges of the frame top section 9 are rounded to lessen the possibility of puncturing the bag.

After the bag is positioned, the clamping ring 17 is fitted over the top section 9. As best seen in FIG. 2, preferably the outer edges of the top section end pieces and sidepieces are angled outward at a small acute angle to vertical, such as about 5 degrees, and the inner periphery of the clamping ring is angled downward and outward at approximately the same angle. The clamping ring and frame upper section 9 are proportioned such that downward movement of the clamping ring 17 over the top section 9 is limited by the wedging fit of the clamping ring over the top section. The ring securely clamps the bag lip so that it will not slip out even if a substantial quantity of trash or other articles are deposited in the bag. With reference to FIG. 4, the bag is not restrained as it would be if inserted in a closed receptacle. The full volume of the bag may be used because it can expand both outward away from the frame side section 2 and at the opposite sides.

When it is desired to remove the bag, the clamping ring 17 can be removed manually and the lip portion of the bag pulled downward through the top section 9 and secured for transit. Then, with reference to FIG. 5, the bottom section 5 can be pivoted to its nested condition and the locking support hinges or braces 16 manually released allowing the top section to be swung downward close alongside the side section 2 for compact storage of the composite bag-supporting frame.

The frame can be formed of plastic or wood. In a representative embodiment, the frame can be about 31 inches and the top and bottom sections can form a square about 15 inches by 15 inches for reliable support of a standard 30 gallon (or larger) trash bag.

I claim:

1. A bag support comprising a frame having a side section including elongated transversely spaced upright posts and means maintaining said posts in substantially parallel relationship, said side section having a top portion and a bottom portion, the bottom portion of said side section between said posts being open and unobstructed, a base section connected to the bottom end portion of said side section and including elongated transversely spaced legs, said legs having corresponding ends pivotally connected to the bottom end portions of said posts and being swingable to a nested position in which said legs extend close alongside and substantially parallel to said posts, said legs being swingable from said nested position through an angle of approximately 270 degrees to a supporting position extending substantially perpendicular to said posts for supporting said side section in upright position, stop means limiting swinging movement of said legs for normally maintaining them in supporting position, a top section forming a closed bag ring having an unobstructed outer periphery and an open interior, said top section including spaced stubs secured along the inner periphery of said bag ring and projecting transversely of and below said bag ring, said portions of said stubs projecting from said bag ring extending close alongside and being pivotally connected to the upper end portions of said posts for swingably connecting said bag ring to the upper end portions of said posts for movement between a bag-supporting position extending substantially perpendicular to said side section with said bag ring positioned above the top ends of said posts and a collapsed position in which said top section is positioned close alongside but connected to said posts, means for normally maintaining said top section with said bag ring in its bag-supporting position but manually releasable for swinging of said bag ring to its collapsed position, and a clamping ring having an inner periphery of approximately the same size and shape as the outer periphery of said bag ring for unobstructed insertion of said clamping ring downward over the outer periphery of said bag ring with at least a portion of the inner periphery of said clamping ring substantially contiguously engaged against a portion of said bag ring, whereby, with said clamping ring removed, the bag can be inserted through the open interior of said bag ring and have its lip folded over said bag ring to extend downward alongside the outer periphery of said bag ring and, thereafter, said clamping ring can be inserted over said bag ring for clamping the entire circumference of the lip portion of the bag to said bag ring.

2. The support defined in claim 1, including short flexible connectors connecting the clamping ring to the frame.

3. The support defined in claim 1, in which the top section includes spaced filler pieces secured along the inner periphery of the top section and projecting therefrom, the portions of said filler pieces projecting from the remainder of the top section being pivotally connected to the upper ends of the posts.

4. The support defined in claim 1, in which the stubs have top edge portions beveled downward and inward to prevent puncturing a bag inserted through the top section.

5. The support defined in claim 1, in which the outer periphery of the bag ring of the top section is angled downward and outward at a small acute angle to the vertical, the inner periphery of the clamping ring being inclined downward and outward at substantially the same small acute angle to the vertical as the bag ring.

6. A bag support comprising a frame having a side section including elongated transversely spaced upright posts and means maintaining said posts in substantially parallel relationship, means for supporting said side section in upright position, a top section forming a bag ring having an unobstructed outer periphery and an open interior, said top section including spaced stubs secured along the inner periphery of said bag ring and projecting transversely of and below said bag ring, said portions of said stubs projecting from said bag ring extending close alongside and being pivotally connected to the upper end portions of said posts for swingably connecting said bag ring to the upper end portions of said posts for movement between a bag-supporting position extending substantially perpendicular to said side section with said bag ring positioned above the top ends of said posts and a collapsed position in which said bag ring is positioned close alongside but connected to said posts, means for normally maintaining said top section with said bag ring in its bag-supporting position but manually releasable for swinging of said bag ring to its collapsed position, and a clamping ring having an inner periphery of approximately the same size and shape as the outer periphery of said bag ring for unobstructed insertion of said clamping ring downward over the outer periphery of said bag ring with at least a portion of the inner periphery of said clamping ring substantially contiguously engaged against a portion of said bag ring, whereby, with said clamping ring removed, the bag can be inserted through the open interior of said bag ring and have its lip folded over said bag ring to extend downward alongside the outer periphery of said bag ring and, thereafter, said clamping ring can be inserted over said bag ring for clamping the entire circumference of the lip portion of the bag to said bag ring.

7. The support defined in claim 6, including short flexible connectors connecting the clamping ring to the frame.

8. The support defined in claim 6, in which the stubs have top edge portions beveled downward and inward to prevent puncturing a bag inserted through the top section.

9. The support defined in claim 6, in which the outer periphery of the bag ring of the top section is angled downward and outward at a small acute angle to the vertical, the inner periphery of the clamping ring being inclined downward and outward as substantially the same small acute angle to the vertical as the top section.

* * * * *